United States Patent [19]

Schmidt

[11] 4,100,972

[45] Jul. 18, 1978

[54] DISPLACEMENT HAMMER APPARATUS FOR SINKING AND LINING BOREHOLES

[76] Inventor: Paul Schmidt, Reiherstrasse, 5940, Lennestadt, Saalhausen, Germany

[21] Appl. No.: 776,914

[22] Filed: Mar. 11, 1977

[30] Foreign Application Priority Data

Mar. 19, 1976 [DE] Fed. Rep. of Germany ..... 2611677

[51] Int. Cl.[2] ..... E21B 11/02

[52] U.S. Cl. ..... 173/23; 173/32; 175/171

[58] Field of Search ..... 175/19–23, 175/103, 171; 173/32, 33, 112, 91

[56] References Cited

FOREIGN PATENT DOCUMENTS

| | | | |
|---|---|---|---|
| 457,465 | 5/1913 | France | 175/23 |
| 454,228 | 9/1936 | United Kingdom | 175/19 |

*Primary Examiner*—Ernest R. Purser

*Attorney, Agent, or Firm*—Toren, McGeady and Stanger

[57] ABSTRACT

Apparatus for sinking a borehole in the ground comprises a self-propelled displacement hammer having a tubular housing containing a percussion mechanism for driving the housing forwards, a follow-up tube arranged to be attached to the rear end of the housing and a bracing cable device arranged to be mounted on the rear end of the follow-up tube for exerting a push on the tube from a bracing cable. Preferably the bracing cable device includes a cable guide sheave which is journalled on a bearing piece at the rear end of the tube and the bearing piece also carries a clamping device for clamping a pulling rope, which in operation of the apparatus has one end fixed to the rear end of the housing and which extends upwards through the follow-up tube for withdrawing the hammer upwards through the follow-up tube from the borehole.

4 Claims, 5 Drawing Figures

16
15
14
13
12
11
7
6
10
8
9
1
2
3
4
5
32
34
35
31
26
21
24
25
33
30
22
27
23
29
28
17
19
18
6
1
19
30
1

DISPLACEMENT HAMMER APPARATUS FOR SINKING AND LINING BOREHOLES

This invention relates to apparatus for sinking boreholes in the ground, the apparatus including a self-propelled displacement hammer having a tubular housing containing a percussion mechanism for driving the housing forwards.

Such self-propelled displacement hammers are used mainly for laying supply lines, such as water mains, electrical mains or telephone lines in the ground beneath roads or pavements, without it being necessary to excavate the road surface or the pavement. As the displacement hammer moves through the ground, it displaces the soil sideways and leaves behind, if the housing is of circular section, a circular duct into which the supply line is pulled either as the hammer advances or subsequently. The ducts formed in this way have both ends open and the hammer starts forming the duct from one end and leaves the duct from the other end.

A method has already also been proposed, for the sinking of substantially vertical boreholes in the ground, for ground anchors, soil grouting or injecting, well construction, drainage or other purposes, by the use of a displacement hammer which displaces the soil sideways. In these boreholes, it is not only necessary to form the boreholes, which are blind holes, rapidly and accurately in the ground, but also subsequently to withdraw the displacement hammer from the borehole.

The aim of the present invention is to provide apparatus for sinking boreholes as described above, by means of which the forming of the borehole and the extraction of the displacement hammer from the borehole is possible in a simple manner.

To this end, according to this invention, apparatus for sinking a borehole in the ground comprises a self-propelled displacement hammer having a tubular housing containing a percussion mechanism for driving the housing forwards, a follow-up tube arranged to be attached to the rear end of the housing and a bracing cable device arranged to be mounted on the rear end of the follow-up tube for exerting on the tube a push from a bracing cable. The borehole is laterally supported by the follow-up tube as the hole is formed so that no soil can fall in. By means of the bracing cable device, the follow-up tube can be forced into the borehole and the apparatus is also constructed so that the hammer can be extracted out of the borehole through the follow-up tube.

The bracing cable device preferably comprises a cable guide sheave which is rotatably journalled on a bearing piece at the rear end of the tube, a tension cable which is arranged to extend over the sheave, means for fixing one end of the cable and a pulling device fixed to the other end of the cable for tensioning the cable to exert the push on the tube. By means of the pulling device, the tension cable is able to exert a compressive force upon the cable sheave and this force is transmitted to the follow-up tube and thus supports the drive movement from the hammer and makes possible an accurate borehole.

In one advantageous embodiment of the invention, the bearing piece also carries a clamping device for clamping a pulling rope, which, in operation of the apparatus has one end fixed in a rope pocket of a cap fixed in the rear end of the housing and which extends through the follow-up tube to the clamping device. By means of the pulling rope, the displacement hammer can be very easily pulled out to the ground surface through the follow-up tube, after the borehole has been completed.

To enable an air hose leading to the displacement hammer for the supply of compressed air to be correctly conducted past the bracing cable device, the bearing piece is preferably mounted on a tubular part which is arranged to be fitted to the rear end of the follow-up tube, the bearing piece being in the form of a mounting arm extending rearwardly from the tubular part.

Preferably, the rope clamping device comprises levers pivoted on the bearing piece and extending parallel to one another and clamping jaws pivotally mounted on the levers. The clamping device is constructed in such a manner that, when the pulling rope is pulled towards the displacement hammer, the device exerts a clamping action, whereas the clamping action is released when the rope is pulled in the other direction. Thus, the pulling rope serves firstly for connecting the follow-up tube to the displacement hammer and secondly for the extraction of the displacement hammer from the borehole.

Two examples of apparatus in accordance with the invention will now be described with reference to the accompanying drawings, in which.

Figures 1, 2, 3:
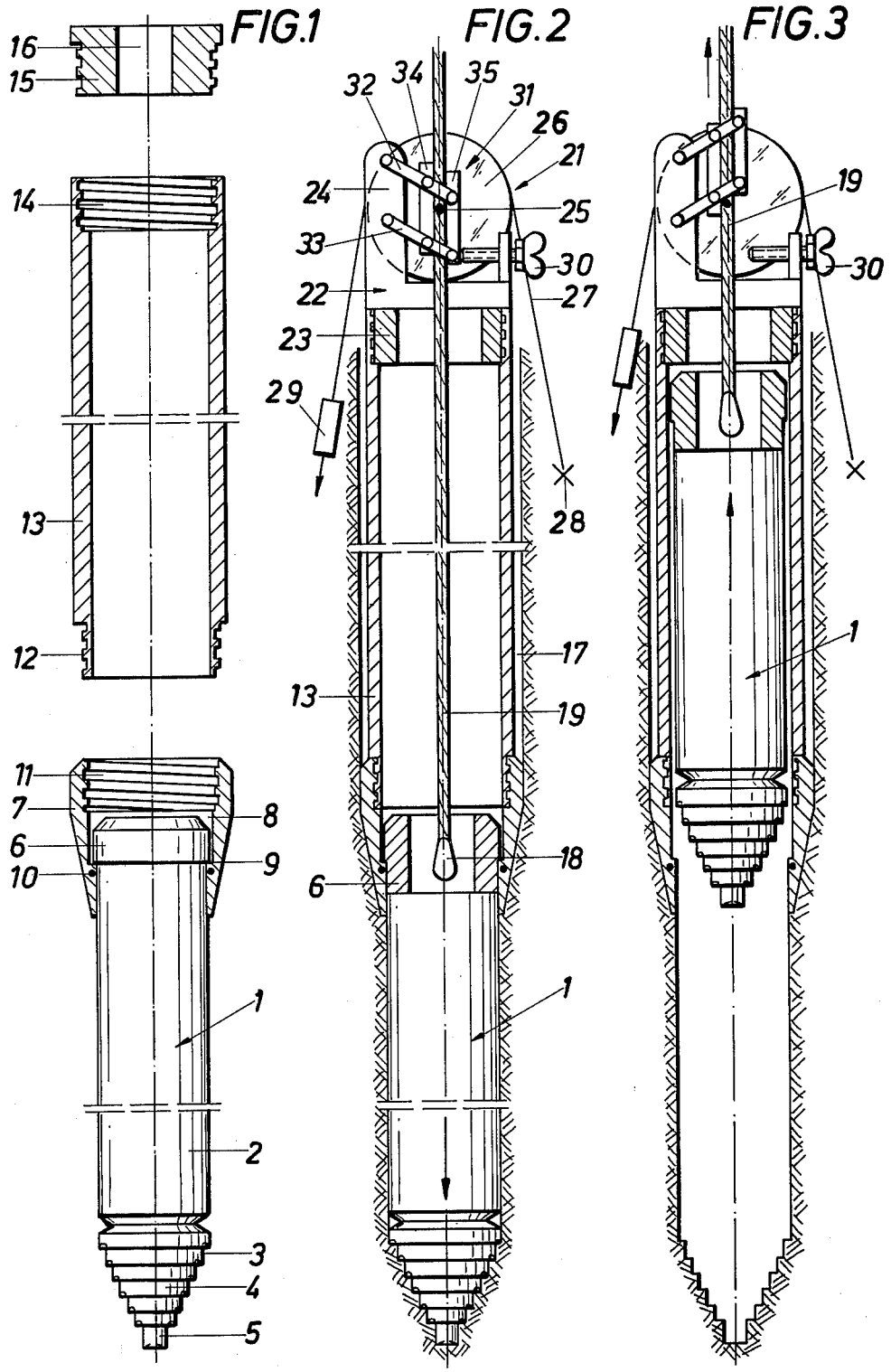
FIG. 1 is an exploded partly sectional side view of a first example comprising a displacement hammer with a follow-up tube arranged to be screwed to the hammer and to be closed by a plug.
FIG. 2 is a partly sectional side view of the apparatus of FIG. 1 shown in a borehole and with a bracing rope device fixed to the rear end of the follow-up tube.
FIG. 3 is a view similar to FIG. 2 but showing the apparatus in the course of being pulled out of the borehole.

Referring to FIG. 1, a pneumatically-operated self-propelled displacement hammer 1 comprises a cylindrical housing 2 with a conical percussion tool 4 having cutting edges 3 disposed at its forward end, a cutting chisel 5 being inserted into the percussion tool. The housing 2 contains a pneumatically-operated percussion mechanism which acts on the tool 4 and propels the hammer 1 forwards. At the rear end of the housing 2, there is an annular flange 6, which is formed on a cap which is screwed into the housing 2 of the displacement hammer 1. The external diameter of the annular flange 6 is larger than the external diameter of the cylindrical housing 2 so that the flange projects radially beyond the housing. At the rear end, the housing 2 is surrounded by a widening sleeve 7 which is partly conical in external shape and has an internal annular rebate 8 which forms an abutment shoulder 9, which bears against the annular flange 6. The diameter of the annular rebate 8 is slightly greater than the external diameter of the annular flange 6, so that the widening sleeve 7 can be pushed over the housing 2 from the front as far as the rear end of the housing 2, and sufficiently far for the shoulder 9 to come into engagement against the annular flange 6.

At its end remote from the housing 2, the widening sleeve 7 has an internal screw thread 11, into which a follow-up tube 13, which is provided at the adjacent end with an external thread 12, is screwed. The follow-up tube 13, which has a length for example of 2 m, is of steel and has at its end remote from the external thread 12, an internal screw thread 14 for the screwing in of further follow-up tubes if required or a plug 15 which has a bore 16. The external diameter of the widening sleeve 7 is slightly greater than the external diameter of the follow-up tube or tubes 13. The internal diameter of the follow-up tube or tubes 13 is slightly greater than the external diameter of the flange 6. In the region of the abutment shoulder 9, between the widening sleeve 7 and the housing 2, there is also a sealing ring 10, to prevent the ingress of water into the follow-up tube 13.

As can be seen from FIG. 2, the external diameter of the follow-up tube 13 is slightly smaller than the diameter of the borehole 17, formed by the widening sleeve of the displacement hammer 1.

In FIG. 2, the displacement hammer 1 is shown in the lower part of a borehole 17 which has been formed by the hammer. In the annular flange 6, a rope pocket 18 is formed for the attachment of a pulling rope 19, which leads to a pulling mechanism, not shown, by means of which the displacement hammer can be pulled back again to the ground surface through the follow-up tube 13, after the borehole 17 has been formed.

As can be seen from FIG. 2, a bracing cable device 21 is disposed at the rear end of the follow-up tube 13. This device comprises a bearing piece 22, which itself comprises a substantially cylindrical tubular part 23, inserted into the rear end of the follow-up tube 13, and a rearwardly extending mounting arm 24. The mounting arm 24 carries an axle 25 of a cable guide sheave 26, over which a tension cable 27 is guided. One end of the tension cable 27 is fixed at 28, while the other end of the tension cable 27 is connected to a pulling device 29.

The mounting arm 24 also carries a clamping device 31, equipped with a wing screw 30. The clamping device 31 comprises levers 32, 33, pivoted on the mounting arm 24, and on which clamping jaws 34, 35 are pivoted. The pulling rope 19 is threaded between the clamping jaws 34, 35. The clamping device 31 is constructed in such a manner that, when a pull is exerted on the pulling rope 19 towards the displacement hammer 1, the rope is clamped, whereas when a pull occurs in the opposite direction there is no clamping action, as can be seen from FIG. 3. Since it is possible for the clamping action of the clamping device 31 to become loosened under the influence of vibration, the clamping device is provided with the wing screw 30, which when screwed up holds the jaws 34, 35 in their clamping position.

The operation of the apparatus is as follows:

To form the borehole 17, the widening sleeve 7 is first pushed over the housing 2 of the displacement hammer 1 from the front until its shoulder 9 abuts against the annular flange 6. Next, a follow-up tube 13 is screwed into the screw thread 11 of the widening sleeve 7 and then the entire apparatus is placed on the ground at the point in which the borehole is to be sunk. By operating the displacement hammer 1 by compressed air, the hammer drives itself into the ground and pulls the follow-up tube 13 after it. This tube 13 is additionally forced downwards by the action of the pulling device 29 acting through the tension cable 27. In this manner the borehole 17 is formed as shown in FIG. 2, the pulling rope 19, which is attached to the annular flange 6, being guided through the clamping device 31. When the desired depth of the borehole 17 has been reached, the pulling rope 19 is pulled upwards by the pulling mechanism, not shown, into the position shown in FIG. 3, the displacement hammer 1 being pulled upwards inside the follow-up tube 13.

If the borehole 17 is to be used as a grouting or injection borehole, then the borehole 17 is filled with a hardening material, for example concrete. For forming a ground anchor, an anchor bar is inserted into the concrete.

Figure 4:
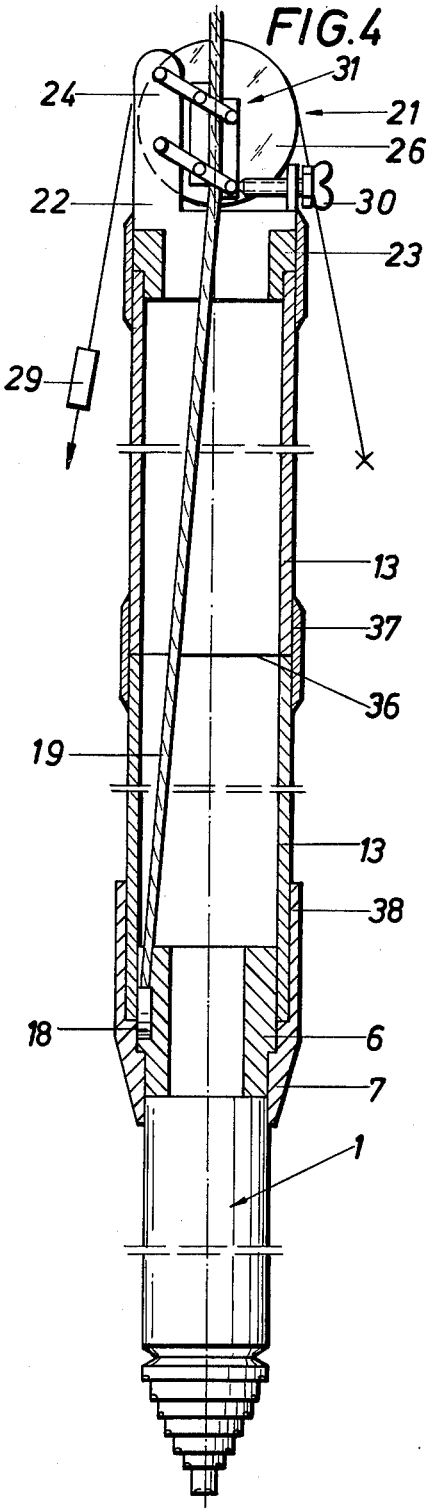
FIG. 4 is a partly sectional side view of a second example having a follow-up tube of plastics material; and, FIG. 5 is a view similar to FIG. 3 but of the second example.
Figure 5:
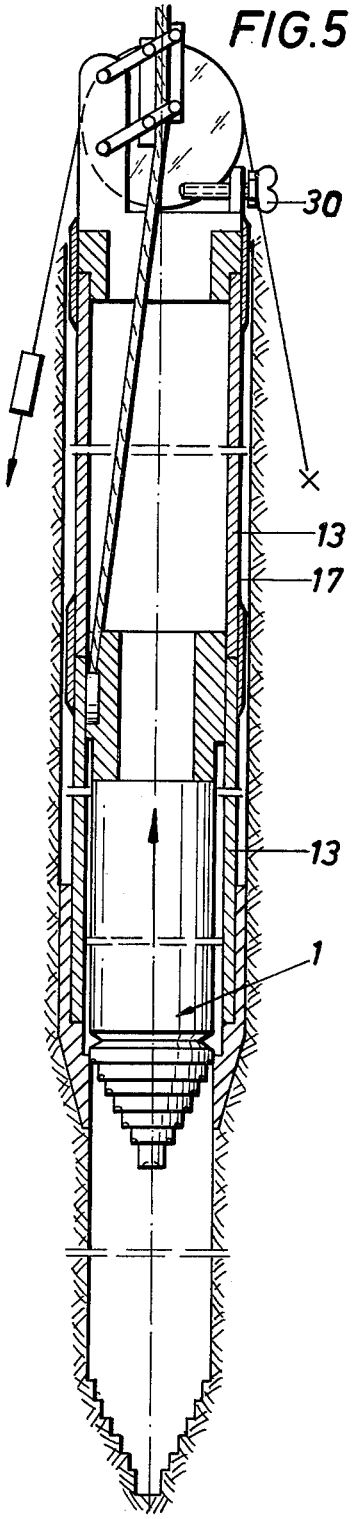

In the example shown in FIGS. 4 and 5, two follow-up tubes 13 are connected together, so that the overall length is increased. In this example, the follow-up tubes 13 are of plastics material. The use of plastics tubes as follow-up tubes 13 is desirable in those cases where the borehole 17 is to be used for well construction or drainage purposes, since the follow-up tubes are not recovered, but remain in the borehole 17. At junction 36, the follow-up tubes 13 are fixed together by a sleeve 37, which surrounds the follow-up tubes 13 and is fixed to them by an adhesive. In the displacement hammer 1, an annular flange 6, formed on a cap, is provided with a rope pocket 18 for the pulling rope 19 as in the first example. The pulling rope 19 is guided back out of the rear follow-up tube 13 and through the clamping device 31, which is carried by the bearing piece 22 in the rear follow-up tube 13. As can be seen from FIG. 4, the forward end of the follow-up tube 13 nearest to the displacement hammer 1 is seated between the annular flange 6 and the widening sleeve 7 which, in this example, has a rearwardly extending, sleeve-like extension 38. The connection between the displacement hammer 1 and the follow-up tube 13 is effected by the pulling rope 19, which is firmly held in the clamping device 31.

With the apparatus in accordance with the invention it is possible for boreholes to be formed in the ground in a very simple manner, without large and complicated drilling apparatus being necessary.

I claim:

1. In apparatus for sinking a borehole in the ground, said apparatus comprising a self-propelled displacement hammer including a tubular housing having a front end and a rear end, and a percussion mechanism for driving said housing forwards in the direction of said front end, the improvement comprising a follow-up tube, means for attaching said follow-up tube to said rear end of said housing, a bracing cable device and means for mounting said bracing cable device on said follow-up tube at an end thereof remote from said housing, said bracing cable device including a bracing cable and means for exerting an axial push on said tube from said bracing cable, said bracing cable device further including a bearing piece, means for mounting said bearing piece at said end of said follow-up tube remote from said housing, a cable guide sheave, means rotatably mounting said sheave on said bearing piece, means extending said bracing cable over said sheave, means for fixing one end of said cable and a pulling device fixed to the other end of said cable for tensioning said cable to exert said push on said tube, a clamping device carried on said bearing piece, a pulling rope extending from said housing through said follow-up tube, said clamping piece being operative to clamp said pulling rope to said tube, a cap fixed in the rear end of said housing, means defining a rope pocket in said cap, and means fixing one end of said rope in said rope pocket.

2. Apparatus as claimed in claim 1, wherein said rope clamping device comprises a plurality of levers, means pivotally mounting said levers on said bearing piece with said levers extending parallel to one another, a plurality of clamping jaws and means pivotally mounting said clamping jaws on said levers.

3. Apparatus as claimed in claim 1, further comprising a tubular part fitted to said end of said follow-up tube remote from said housing, and means mounting said bearing piece on said tubular part, said bearing piece comprising a mounting arm extending rearwardly from said tubular part.

4. Apparatus as claimed in claim 3, further comprising safety screw means and means threadedly mounting said safety screw means on said tubular part, said safety screw means being operative to cause said clamping device to clamp said rope.

* * * * *